US005355539A

United States Patent [19]

Boettger

[11] Patent Number: 5,355,539

[45] Date of Patent: Oct. 18, 1994

[54] CLAMP FOR INTERCONNECTING A FREE STANDING, WHEELED INTRAVENOUS POLE WITH A MOBILE GURNEY

[75] Inventor: Conrad H. Boettger, Hesston, Kans.

[73] Assignee: St. Francis Research Institute, Wichita, Kans.

[21] Appl. No.: 5,825

[22] Filed: Jan. 19, 1993

[51] Int. Cl.[5] ..... A47C 21/00; F17L 3/00

[52] U.S. Cl. ..... 5/503.1; 5/658; 24/265 C; 24/525; 248/122; 248/231.7; 280/250.1; 280/304.1; 403/384; 403/393

[58] Field of Search ..... 5/658, 503.1; 280/304.1, 250.1; 248/231.7, 122; 24/265 C, 569, 525; 403/384, 398

[56] References Cited

U.S. PATENT DOCUMENTS

| | | | |
|---|---|---|---|
| D. 287,055 | 12/1986 | Fick et al. | D24/128 |
| 4,511,157 | 4/1985 | Wilt, Jr. | 297/DIG. 4 |
| 4,511,158 | 4/1985 | Varga et al. | 5/285 |
| 4,547,092 | 10/1985 | Vetter et al. | 403/59 |
| 4,600,209 | 7/1986 | Kerr, Jr. | 5/503.1 |
| 4,676,687 | 6/1987 | Koffler | 403/384 |
| 4,729,576 | 3/1988 | Roach | 5/658 |
| 4,945,592 | 8/1990 | Sims et al. | 5/658 |
| 5,135,191 | 8/1992 | Schmuhl | 5/658 |
| 5,149,036 | 9/1992 | Sheehan | 5/658 |

*Primary Examiner*—Alexander Grosz
*Attorney, Agent, or Firm*—Hovey, Williams, Timmons & Collins

[57] ABSTRACT

A clamping assembly (10) is provided for releasably connecting a mobile support stand (52) with a patient transport device such as a gurney (54), in order to allow patient transfer with the support stand while eliminating the need for extra transport personnel. The clamping assembly (10) preferably includes a pair of opposed, laterally spaced apart jaws (20, 22) interconnected by a central bight section (24). A pair of oppositely extending elongated connection elements (14, 16) are secured to the opposed faces of the bight section (24), and permit the clamping assembly to be releasably and pivotally inserted into a tubular section (66) conventionally provided as a part of the gurney (54). A clamping screw (18) is threadably received by one of the jaws (20) and cooperates with the opposed jaw (22) for securely clamping the upright standard (60) of the pole unit (52) within the clamping assembly (10).

8 Claims, 1 Drawing Sheet

CLAMP FOR INTERCONNECTING A FREE STANDING, WHEELED INTRAVENOUS POLE WITH A MOBILE GURNEY

BACKGROUND OF THE INVENTION

1. Field of the Invention

The present invention is broadly concerned with an improved clamping assembly adapted for releasably connecting a mobile, free standing support stand (e.g., a wheeled stand for supporting intravenous fluids and related equipment) to a patient transfer device such as a gurney, bed or wheelchair in such manner as to securely couple the support stand and permit movement of the transfer device and stand in unison by a single attendant. More particularly, the invention concerns such a clamping assembly which preferably includes a clamp body having a pair of spaced apart, opposed jaws cooperatively defining a recessed area for receiving therein the upright standard forming a part of the support stand, with the body also including at least one upstanding, elongated, transversely oriented connector element adapted to mount the clamp body onto the tubular IV pole adapters typically found on gurneys, beds and wheelchairs.

2. Description Of the Prior Art

One of the most common tasks in a hospital is that of transporting sitting or recumbent patients between wards or to various locations in the hospital. In many cases, such patients are undergoing intravenous fluid therapy, and it is important to transfer the IV assembly along with the patient, in order to eliminate the necessity of terminating the IV infusion during transport. Typical IV assemblies include a free standing, wheeled support stand having a castered base with an upright standard, the latter having one or more limbs adjacent the upper end thereof.

One response to this problem is to use two attendants for the patient transfer, one to push and guide the patient transfer device (e.g., a gurney, mobile bed or wheelchair), while the other attendant pushes and guides the IV assembly. Obviously, this is a costly approach, and is extremely inefficient from the standpoint of manpower utilization.

SUMMARY OF THE INVENTION

The present invention overcomes the problems outlined above, and provides a clamping assembly for permitting releasable interconnection for a mobile transfer device and a separate mobile support stand, with the connection permitting the stand to be pulled along with the transport device without the need of an extra attendant.

Broadly speaking, the clamping assembly of the invention includes a clamp body presenting a pair of spaced apart jaws cooperatively defining a recessed area configured for receiving the upright standard of a mobile support stand, with the jaws being equipped with structure for releasably maintaining the standard therein. In addition, the clamp body has at least one, and preferably a pair of, transverse connection elements adapted to be received within a typical upright, tubular IV pole adapters found on virtually all patient transfer devices.

In preferred forms, the connection elements are in the form of oppositely extending members each presenting a cylindrical shank portion with a tapered end remote from the clamp body. These elements are moreover configured with shanks of different relative diameters, so as to permit the clamp assembly to be used with different sizes of tubular adapters. Additionally, one of the jaw sections of the clamp body is advantageously configured to present a generally V-shaped segment in plan configuration, and a clamping screw is mounted in the other of the jaw segments; the clamping screw includes an inner clamping end which is positioned adjacent the V-shaped segment, so that an upright standard can be securely clamped in place between the clamping screw and V-shaped segment. At the same time, insertion of a connector element within the tubular adapter of a patient transport device allows the coupled support stand to freely pivot during transport to thereby follow the patient transfer device without the need for an attendant.

DETAILED DESCRIPTION OF THE PREFERRED EMBODIMENTS

Figure 1:
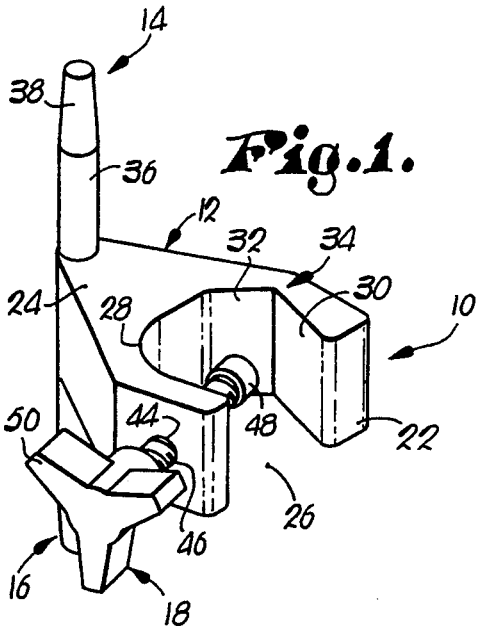
FIG. 1 is a perspective view of the preferred clamping assembly in accordance with the invention.
Figure 2:
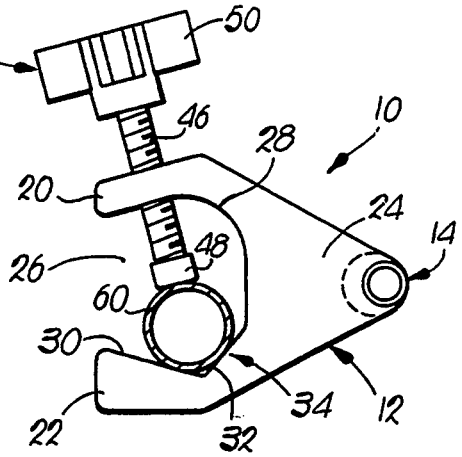
FIG. 2 is a plan view of the clamping assembly, shown as it would appear when used to clamp an upright standard.
Figure 3:
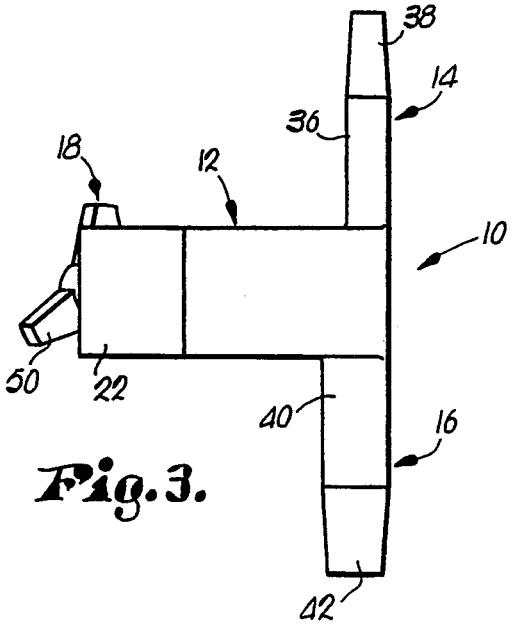
FIG. 3 is a side elevational view of the preferred clamping assembly.

Turning now to the drawings, and particularly FIGS. 1–3, a clamping assembly 10 in accordance with the invention is illustrated. Broadly speaking, the assembly 10 includes a main body 12 together with a pair of oppositely extending, differently configured connector elements 14 and 16. In addition, the body 12 carries a threaded, axially rotatable clamping screw 18.

In more detail, the body 12 is preferably an integral unit and is configured to present a pair of opposed, laterally spaced apart jaws 20, 22 which are interconnected by a central bight section 24 of somewhat triangular configuration in plan. The jaws 20, 22 and bight section 24 cooperatively define a recessed area 26 as best seen in FIG. 2. The inner defining surface of jaw 20 is substantially planar and is curvilinear as at 28 at the transition between the jaw and the central bight section 24. On the other hand, the inner defining surface of opposed jaw 22 presents a pair of intersecting, generally planar surfaces 30, 32 which cooperatively present a generally V-shaped segment 34 at the inboard region of jaw 22.

Connection element 14 is located at the apex of the bight section 24 and presents a cylindrical shank portion 36 as well as a tapered outermost end 38 remote from the body 12. Likewise, it will be observed that the connection element 16 is mounted at the apex of the section 24, and includes a cylindrical shank portion 40 as well as a tapered outer end 42. As best illustrated in FIG. 3, the respective shank portions 36, 40 forming a part of the elements 14, 16 extend in opposite directions from the opposed upper and lower surfaces of the body 12. Moreover, these shank portions are of different diameters, i.e., the shank portion 36 has a smaller diameter than that of the opposed shank portion 40.

Clamping screw 18 is threadably received by an appropriately threaded aperture 44 provided in jaw 20. As best illustrated in FIG. 2, the screw 18 includes an elongated threaded shank 46 with a resilient, cup-like cap 48 secured on the inner end thereof within recessed area 26. It will also be noted that the longitudinal axis of the shank 46 is substantially aligned with the apex of V-shaped segment 34, and is of a length to extend to a position very close to surfaces 30, 32. The outermost end of the shank 46 located outside of the recessed area 26 is equipped with a handle 50 allowing easy manipulation of the clamping screw.

Figure 4:
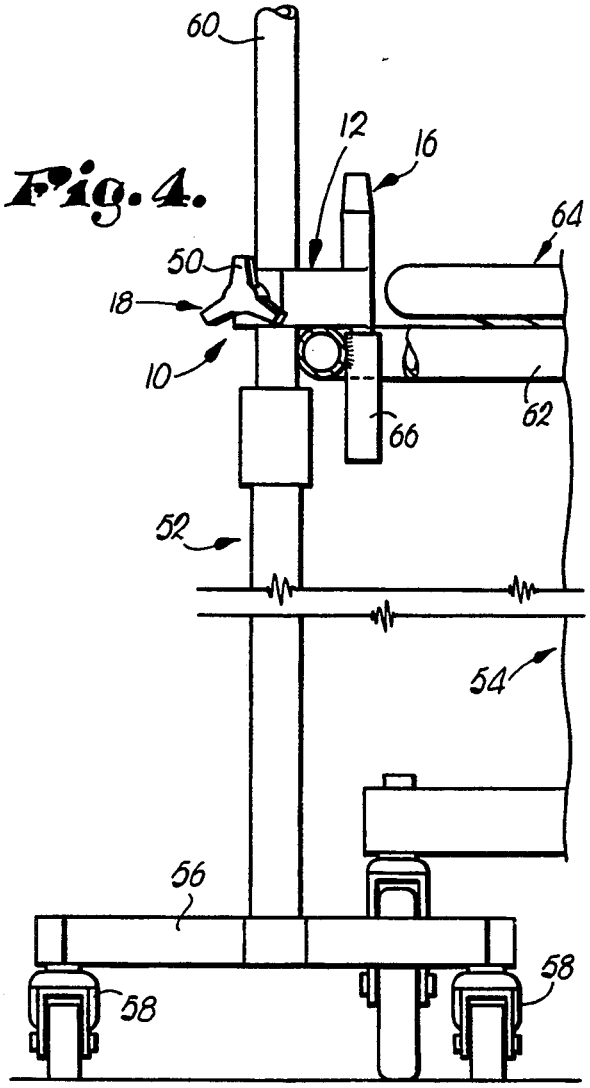
FIG. 4 is a fragmentary end view illustrating the use of the clamping assembly in releasably securing a conventional wheeled IV support stand to a patient gurney.

FIG. 4 illustrates the use of clamping assembly 10 for connecting a free standing IV pole unit 52 to a conventional patient gurney 54. The pole unit 52 includes a relatively wide base 56 provided with caster wheels 58, as well as an elongated, upstanding, two-piece telescopically interfitted standard 60. Although not shown, those skilled in the art will appreciate that appropriate limbs or other structure is provided at the upper end of the standard 60 for supporting supplies of IV liquid or other equipment. Gurney 54 includes a frame assembly 62 as well as a patient bed 64. In addition, gurneys of this type are conventionally provided with upstanding, upwardly opening tubular sections adjacent the corners thereof, such as the section 66 illustrated.

In the use of clamping assembly 10, one of the connection elements 14 or 16 is inserted into a convenient tubular section 66 in such manner as to allow free pivoting of the clamping assembly therein. At this point, the pole unit 52 is wheeled to a position adjacent the clamping assembly, and is moved so that the standard 60 thereof is positioned within recessed area 26, and specifically adjacent the planar surfaces 30, 32. In order to complete the connection, it is only necessary to manipulate handle 50 in order to tighten the inner end of the clamping screw against the standard 60, thereby firmly clamping the latter between the clamping screw and the V-shaped segment 34. In this orientation, the gurney 54 can be conventionally moved and guided, with the pole unit 52 being securely attached and following the gurney, all without the need for an extra attendant.

It will be appreciated in this respect that the interfit between the connection element 14 or 16 and the tubular section 66 allows the pole unit 52 to pivot about the axis of the connection element. Thus, the coupled pole unit can easily negotiate turns with the gurney 54, while remaining completely stable. Use of differently sized connection elements 14, 16 allows the clamping assembly to be universally employed on virtually all commonly used patient transport devices, such as gurneys, wheelchairs or hospital beds.

I claim:

1. In combination:

a mobile patient transfer device presenting a frame and an upstanding, upwardly opening tubular section;

a support stand including a wheeled base and an upright standard secured to said base; and means for releasably coupling said support stand to said transfer device in order to permit movement thereof together, including a clamp body presenting a pair of spaced apart jaws cooperatively defining a recessed area receiving said standard, an elongated connector element secured to said body and oriented transverse to said jaws and positioned within said tubular section, and means for releasably maintaining said standard within said recessed area, said connector element and tubular section permitting relative pivoting movement between the transfer device and support stand.

2. The combination of claim 1, said patient transfer device comprising a gurney presenting a generally horizontal patient support bed, said tubular section being adjacent a side margin of said bed.

3. The combination of claim 1, said clamp assembly including a pair of oppositely extending connector elements each oriented transverse to said jaws and secured to said clamp body, said pair of connector elements having different maximum cross-sectional dimensions respectively for alternate placement of the elements in tubular sections of different diameter.

4. The combination of claim 1, said standard-retaining means comprising a clamping screw operatively secured to and extending through one of said jaws and into said recessed area, with the inner end of said clamping screw engaging said standard and clamping the latter against the other of said jaws.

5. A clamping assembly for permitting releasable interconnection of a mobile patient transfer device and a separate support stand, said transfer device presenting an upstanding, upwardly opening tubular section, said support stand including a wheeled base, and an upright standard secured to said base, said clamping assembly comprising:

a clamp body presenting a pair of spaced apart jaws cooperatively defining a recessed area and configured for receiving said standard;

an elongated connector element secured to said body and oriented transverse to said jaws, said connector element being configured for receipt within said tubular section in order to permit relative pivoting movement between said transfer device and support stand when the latter are moved in unison; and means for releasably maintaining said standard within said recessed area.

6. The clamping assembly of claim 5, said clamp body including a pair of oppositely extending connector elements secured thereto and each oriented transverse to said jaws, said pair of connector elements having different maximum cross-sectional dimensions respectively for alternate placement of the elements in tubular sections of different diameter.

7. The clamping assembly of claim 5, said standard-retaining means comprising a clamping screw operatively secured to and extending through one of said jaws and into said recessed area, with the inner end of said clamping screw being configured for engaging said standard and clamping the latter against the other of said jaws.

8. A clamping assembly for permitting releasable interconnection of a mobile patient transfer device and a separate support stand, said transfer device presenting an upstanding, upwardly opening tubular section, said support stand including a wheeled base, and an upright standard secured to said base, said clamping assembly comprising:

a clamp body presenting opposed upper and lower surfaces, and a pair of laterally spaced apart, opposed jaw sections interconnected by a bight section, the inner defining surfaces of one of said jaws being configured to present a generally V-shaped segment in plan configuration;

a pair of oppositely outwardly extending connector elements secured to said bight section between said jaw sections, each of said elements having a substantially cylindrical shank and a tapered outer end remote from said clamp body, the shank of one of said elements having a diameter greater than the shank of the other of said elements;

an axially rotatable clamping screw extending through and being threadably coupled to the other of said jaw sections, said clamping screw including an inner end adjacent said generally V-shaped segment of said one jaw section, said V-shaped segment and inner end of said screw being cooperatively configured for engaging and clamping said standard with said inner end of said screw clamping the standard against the defining walls of said V-shaped segment.

* * * * *